US005197300A

United States Patent [19]

Sakamoto et al.

[11] Patent Number: 5,197,300

[45] Date of Patent: Mar. 30, 1993

[54] AUGER TYPE ICEMAKER

[75] Inventors: Shigetoshi Sakamoto, Nagoya; Sakichi Kawasumi, Toyoake; Junichi Hida, Nagoya, all of Japan

[73] Assignee: Hoshizaki Denki Kabushiki Kaisha, Toyoake, Japan

[21] Appl. No.: 822,019

[22] Filed: Jan. 17, 1992

[30] Foreign Application Priority Data

Jan. 18, 1991 [JP] Japan ..... 3-5441[U]

[51] Int. Cl.[5] ..... F05C 1/14

[52] U.S. Cl. ..... 62/354

[58] Field of Search ..... 62/354

[56] References Cited

U.S. PATENT DOCUMENTS

| | | | |
|---|---|---|---|
| 3,196,628 | 7/1965 | Reynolds | 62/354 X |
| 3,863,463 | 2/1975 | Utter et al. | 62/354 |
| 4,467,622 | 8/1984 | Takahashi et al. | 62/354 |
| 4,497,184 | 2/1985 | Utter et al. | 62/354 |
| 4,574,593 | 3/1986 | Nelson | 62/354 X |
| 4,741,173 | 5/1988 | Neumann | 62/298 |

*Primary Examiner*—William E. Tapolcai
*Attorney, Agent, or Firm*—Nikaido, Marmelstein, Murray & Oram

[57] ABSTRACT

An auger type icemaker including an evaporator housing having a cylindrical inner freezing surface on which ice crystals may form, an auger mounted for rotary movement within the housing to be driven to scrape ice crystals off the freezing surface and to advance the scraped ice crystals toward an upper end portion of the housing, an extrusion head formed with a plurality of ice extruding passages and axially slidably coupled within an annular space between the upper end portion of the housing and an upper shaft portion of the auger, wherein a screw is threaded into the upper end portion of the housing and engaged with an axial key-groove of the extrusion head to restrict rotary movement of the extrusion head, and a cam mechanism mounted on the upper shaft portion of the auger to effect axial movement of the extrusion head in accordance with rotary movement of the auger and to restrict upward movement of the extrusion head at an upper dead point thereof.

5 Claims, 7 Drawing Sheets

AUGER TYPE ICEMAKER

BACKGROUND OF THE INVENTION

1. Field of the Invention

The present invention relates to auger type icemakers, and more particularly to a mounting construction of an extrusion head in the auger type icemakers.

2. Description of the Prior Art

As disclosed in U.S. Pat. No. 4,741,173 issued on May 3, 1988, a conventional auger type icemaker includes an evaporator housing with a cylindrical inner wall providing a freezing surface on which ice crystals may form, an auger mounted for rotary movement within the housing to be driven to scrape ice crystals off the freezing surface and to advance the scraped ice crystals toward the upper end of the housing, an extrusion head formed with a plurality of ice extruding passages, and means for stationally mounting the extrusion head at the upper end of the housing. In the icemaker of this type, the extrusion head is coupled within an annular space between the upper end of the housing and an upper shaft portion of the auger and fixed to the housing in circumferential and axial directions. In operation, the scraped ice crystals from the auger is fed into and compressed in the extruding passages of the head to be discharged as rods of ice therefrom. In the course of compressing the scraped ice crystals, relatively large thrust forces exerted by the auger act on the evaporator housing through the extrusion head in an axial direction. For this reason, it is required to increase the wall thickness of the evaporator housing and use large screws for mounting the extrusion head in place.

SUMMARY OF THE INVENTION

It is, therefore, a primary object of the present invention to provide an improved mounting construction of the extrusion head capable of overcoming the problems described above.

According to the present invention, the object is accomplished by providing an auger type icemaker including an evaporator housing having a cylindrical inner freezing surface on which ice crystals may form, an auger mounted for rotary movement within the housing to be driven to scrape ice crystals off the freezing surface and to advance the scraped ice crystals toward an upper end of the housing, an extrusion head formed with a plurality of ice extruding passages and coupled within an annular space between the upper end portion of the housing and an upper shaft portion of the auger, and means for stationarily mounting the extrusion head at the upper end portion of the housing, wherein the mounting means comprises first means for restricting rotary movement of the extrusion head at the upper end portion of the housing and second means mounted on the upper shaft portion of the auger for restricting upward movement of the extrusion head to absorb a major portion of thrust forces generated by the action of the auger in feeding the scraped ice crystals into the ice extruding passages of the extrusion head.

In an aspect of the present invention, the extrusion head is axially slidably coupled within the annular space between the upper end portion of the housing and the upper shaft portion of the auger, and the second means for restricting upward movement of the extrusion head comprises a cylindrical connecting member fixedly coupled within a bore of the extrusion head and extending upwardly therefrom, a cam ring formed thereon with a cam surface and mounted on an upper end of the connecting member, a support shaft coaxially connected to the upper shaft portion of the anger for rotation therewith, and a cam follower element mounted on the support shaft and maintained in engagement with the cam surface of the cam ring for restricting upward movement of the extrusion head at an upper dead point thereof.

In another aspect of the present invention, the second means for restricting upward movement of the extrusion head comprises a thrust bearing mounted the upper shaft portion of the auger to abosorb a major portion of thrust forces generated by the action of the auger in feeding the scraped ice crystals into the ice extruding passages of the extrusion head.

BRIEF DESCRIPTION OF THE DRAWINGS

Other objects, features and advantages of the present invention will be more readily appreciated from the following detailed description of preferred embodiments thereof when taken together with the accompanying drawings, in which.

DESCRIPTION OF THE PREFERRED EMBODIMENTS

Figure 1:
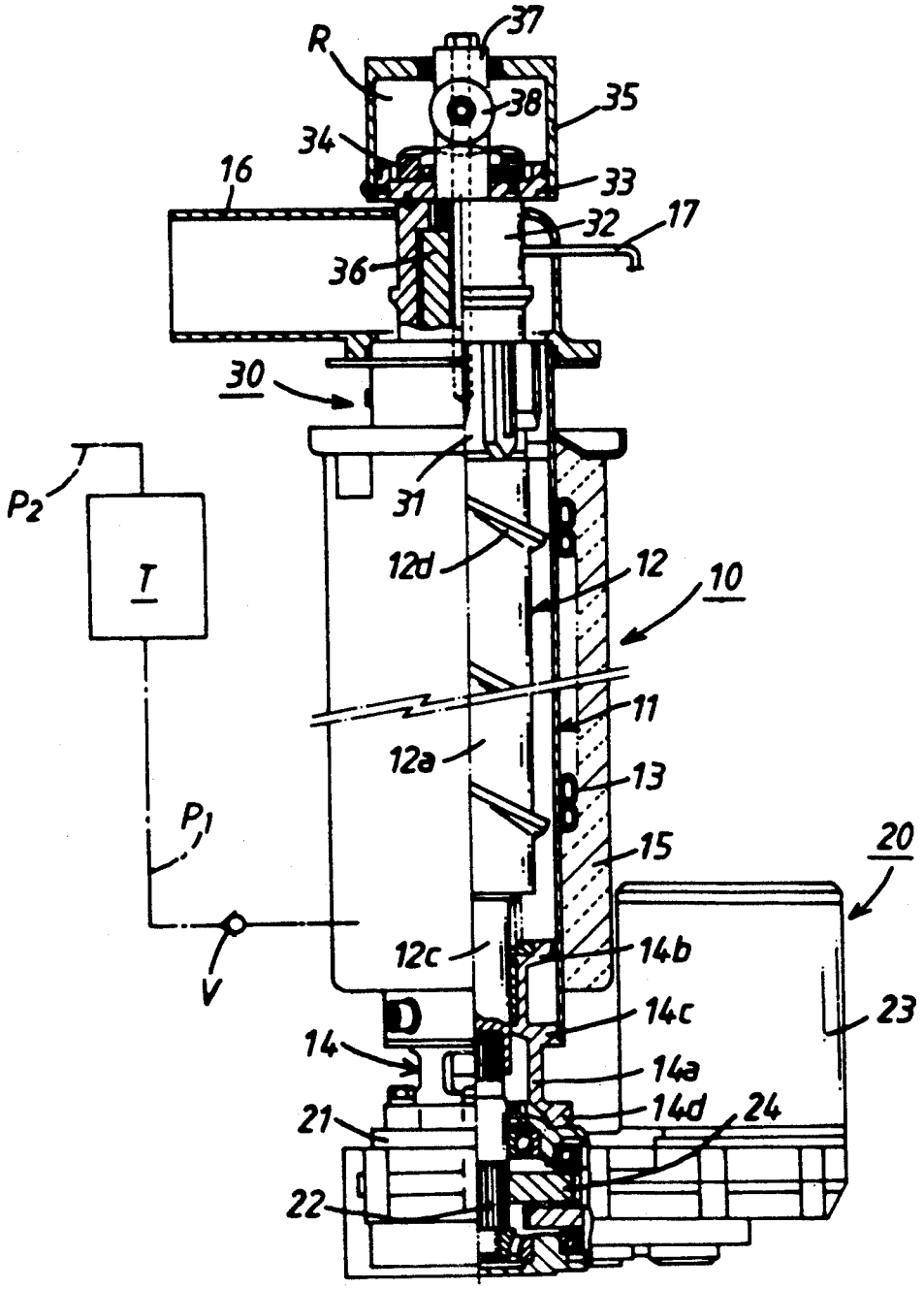
FIG. 1 is a partly broken sectional view of an auger type icemaker in accordance with the present invention.

Referring now to the drawings, FIG. 1 illustrates an auger type icemaker which includes a freezing mechanism 10, a drive mechanism 20 and an extrusion head assembly 30. The freezing mechanism 10 includes an upright cylindrical evaporator housing 11 surrounded by a refrigerating coil 13 through which refrigerant is passed in a usual manner to chill the housing 11 and an auger 12 mounted for rotary movement within the evaporator housing 11 to which fresh water is supplied from a water tank T through a water supply pipe $P_1$ to cause ice crystals to form on the internal freezing surface of the evaporator housing 11. The evaporator housing 11 is vertically mounted on a housing 21 of the drive mechanism 20 through a hollow support member 14. The support member 14 has a cylindrical body portion 14*a* which is formed with a pair of axially spaced annular flanges 14*b*, 14*c* coupled in a liquid-tight manner within the lower end portion of the evaporator housing 11 and a lower annular flange 14*d* secured to the housing 21 of the drive mechanism 20 for supporting the evaporator housing 11 in place. The refrigerating coil 13 is provided as a part of a refrigeration circuit (not shown) and is surrounded by an insulation material 15.

Figure 16:
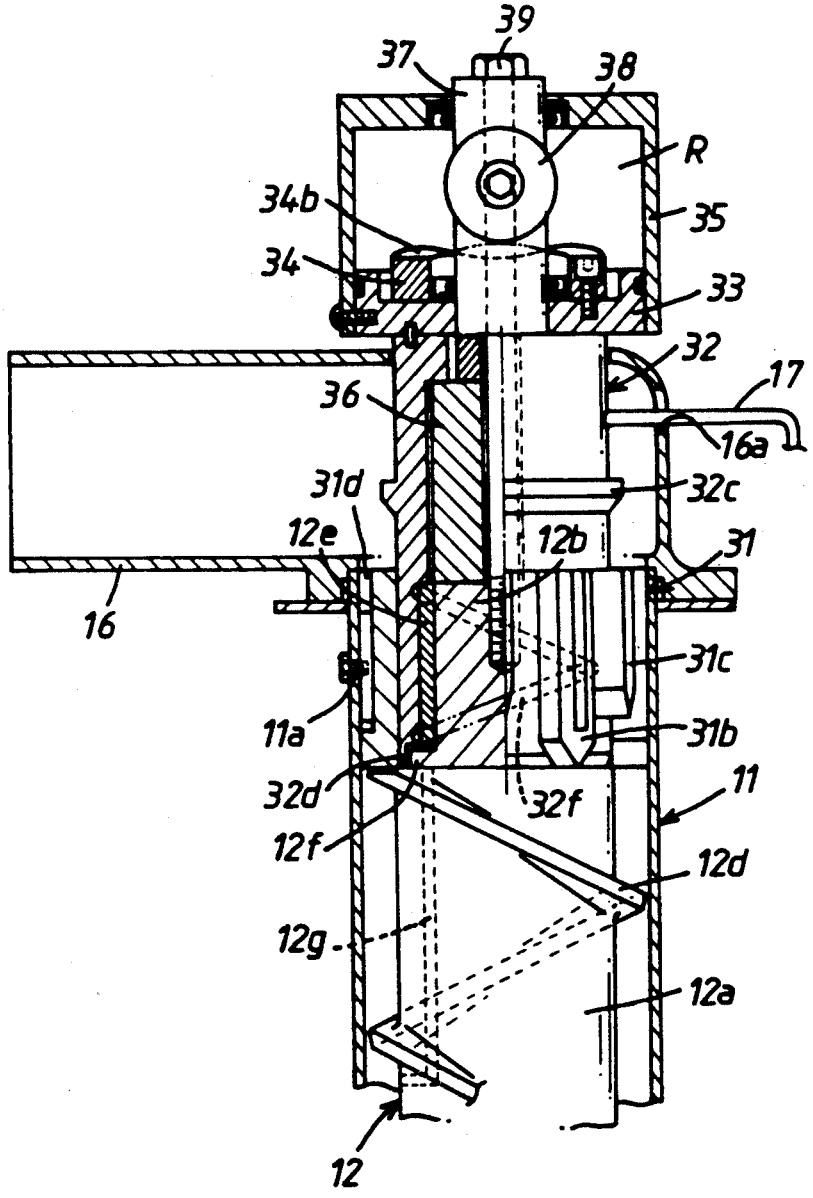
FIG. 16 is a partly broken sectional view showing a first mode of operation of the icemaker shown in FIG. 1.

As shown in FIGS. 1 and 16, the auger 12 has a body portion 12*a* of large diameter integrally formed thereon with a helical blade 12*d* and upper and lower shaft portions 12*b* and 12*c*. The lower shaft portion 12*c* of auger 12 is rotatably carried by the support member 14 and is drivingly connected to a drive shaft 22 of the drive mechanism 20. The upper shaft portion 12*b* of auger 12 is rotatably carried by a liner sleeve 12*e* of a suitable bearing material coupled with an extrusion head 31 through a cylindrical connecting member 32. The water supply pipe $P_1$ is connected at its one end to the evaporator housing 11 at a position facing a lower portion of auger 12 and connected at its other end to the water tank T. A check valve V is disposed within the water supply pipe $P_1$ to permit only the flow of fresh water supplied therethrough from the water tank T into the interior of evaporator housing 11. The water tank T is connected to a source of fresh water (not shown) through a connecting pipe $P_2$ and contains therein a float valve (not shown) for storing a predetermined amount of fresh water in operation of the icemaker. The drive mechanism 20 includes an electric motor 23 which is drivingly connected to the drive shaft 22 by means of a speed reduction gear train 24. In operation of the electric motor 23, the drive shaft 22 is driven by a drive torque applied thereto through the speed reduction gear train 24 to rotate the auger 12.

Figure 2:
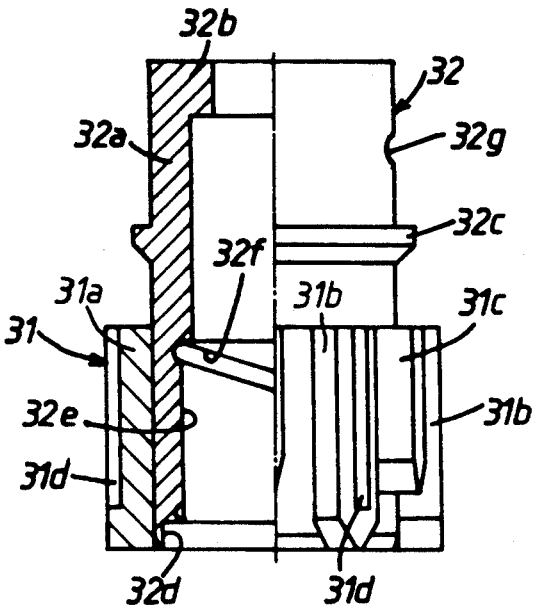
FIG. 2 is a partly broken sectional view of an assembly of an extrusion head and a cylindrical connecting member shown in FIG. 1.
Figure 3:
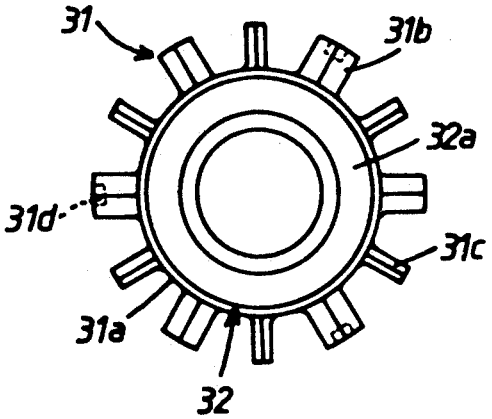
FIG. 3 is a bottom view of the extrusion head assembly shown in FIG. 2.
Figure 4:
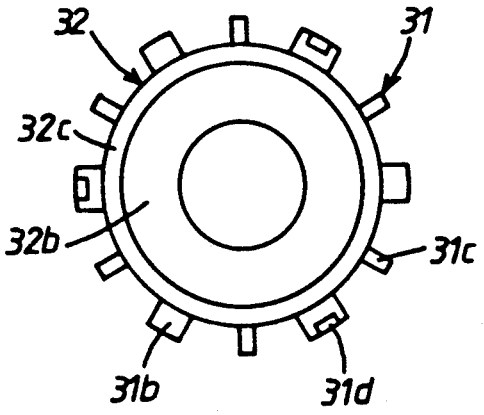
FIG. 4 is a plan view of the extrusion head assembly shown in FIG. 2.

As shown in FIGS. 2 to 4, the extrusion head assembly 30 includes the extrusion head 31 unitedly coupled with the cylindrical connecting member 32. The extrusion head 31 has a cylindrical body portion 31*a* which is formed with a plurality of circumferentially equally spaced full fins 31*b* and a plurality of relatively shorter fins 31*c* located between adjacent pairs of full fins 31*b*. The full fins 31*b* are extended from top to bottom of the body portion 31*a* and tapered to knife edges at the lower ends thereof. The full fins 31*b* are formed lager in width than the shorter fins 31*c*, and the three full fins 31*b* each are formed with an axial key-groove 31*d*. The shorter fins 31*c* are extended downwardly from the top of body portion 31*a* for a distance which is less than the full length of body portion 31*a*. Similarly to the full fins 31*b*, the shorter fins 31*c* are tapered to knife edges at the lower ends thereof. The cylindrical connecting member 32 has an axially elongated cylindrical body portion 32*a* which is formed at its upper end with a radially inwardly extending annular flange 32*b* and at its intermediate portion with a radially outwardly extending annular flange 32*c*. The cylindrical connecting member 32 is inserted into a central bore of the extrusion head 31 with a press fit and projected upwardly from the extrusion head 31 in a predetermined length. The cylindrical connecting member 32 is formed at its internal lower end with an annular recess 32*d* and has a cylindrical internal wall surface 32*e* formed with a spiral groove 32*f*.

As clearly shown in FIGS. 1 and 16, the extrusion head 31 is axially slidably assembled within the upper end portion of evaporator housing 11, and key screws 11*a* are radially threaded into the evaporator housing 11 and engaged with the key-grooves 31*d* of full fins 31*b* to restrict rotary movement of the extrusion head 31 relative to the evaporator housing 11. In the course of assembling the extrusion head 31, the liner sleeve 12*e* is coupled within the lower portion of cylindrical connecting member 32 to rotatably support the upper shaft portion 12*b* of auger 12, and the full and shorter fins 31*b*, 31*c* of head 31 are engaged with the internal cylindrical surface of evaporator housing 11 to form a plurality of ice extruding passages. In such a condition, the cylindrical connecting member 32 is extended upwardly across a discharge duct 16 mounted on the upper end of evaporator housing 11, and an upper support member 33 is fixedly mounted on the upper end of connecting member 32. The lower end annular recess 32*d* of connecting member 32 is coupled with an annular shoulder 12*f* formed between the body portion 12*a* and upper shaft portion 12*b* of auger 12, and the lower end of spiral groove 32*f* is communicated with the upper end of a communication passage 12*g* formed in the auger 12. The communication passage 12*g* is communicated at its lower end with the fresh water supplied into the evaporator housing 11 to be frozen.

Figure 5:
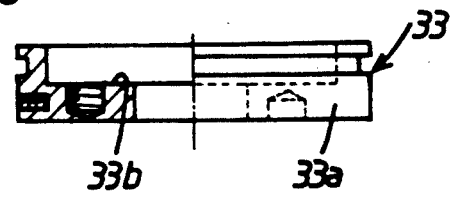
FIG. 5 is a partly sectional view of a support member shown in FIG. 1.
Figure 6:
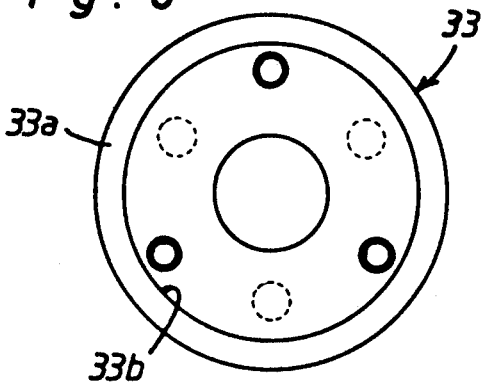
FIG. 6 is a plan view of the support member shown in FIG. 5.
Figure 7:
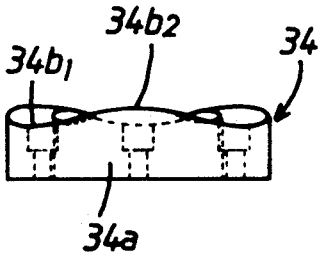
FIG. 7 is a side view of a cam ring shown in FIG. 1.
Figure 8:
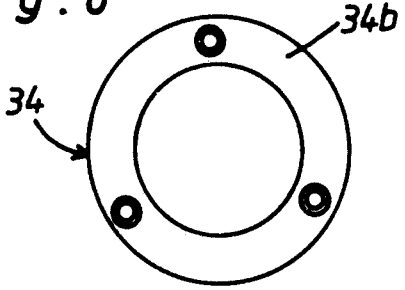
FIG. 8 is a plan view of the cam ring shown in FIG. 7.
Figure 9:
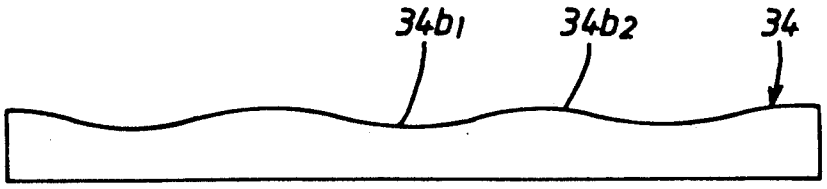
FIG. 9 is a development view of the cam ring shown in FIG. 7.
Figure 10:
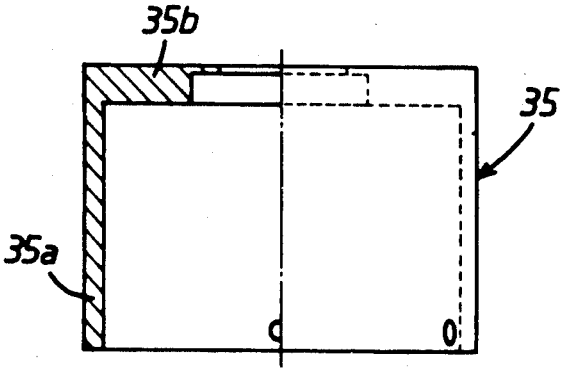
FIG. 10 is a partly broken sectional view of a head case shown in FIG. 1.
Figure 11:
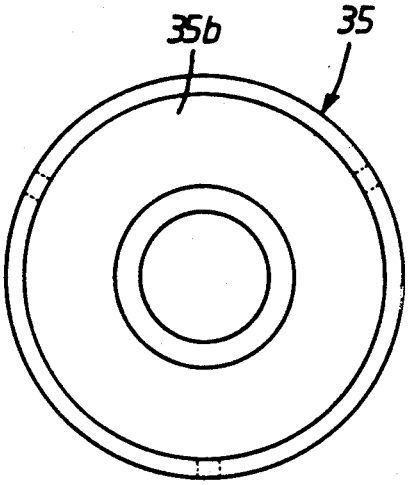
FIG. 11 is a bottom view of the head case shown in FIG. 10.

As shown in FIGS. 5 and 6, the upper support member 33 is in the form of a dish plate which has a circular body portion 33*a* formed with a central circular recess 33*b*. As shown in FIG. 1, a cam ring 34 is assembled within the central circular recess 33*b* of support member 33, and a head case 35 is coupled over the circular body portion 33*a* of support member 33. As shown in FIGS. 7 to 9, the cam ring 34 has an annular body portion 34*a* formed thereon with a cam surface 34*b* having circumferentially equally spaced concave portions $34b_1$ and convex portions $34b_2$. As shown in FIGS. 10 and 11, the head case 35 has a cylindrical body portion 35*a* formed at its upper end with a radially inwardly extending flange 35*b*. The cylindrical body portion 35*a* of head case 35 is fixedly coupled at its lower end with the circular body portion 33*a* of support member 33 in a liquid-tight manner to form a chamber R for containing therein cam follower rollers 38 mounted on a support shaft 37.

Figure 12:
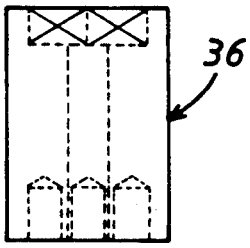
FIG. 12 is a side view of a connecting shaft shown in FIG. 1.
Figure 13:
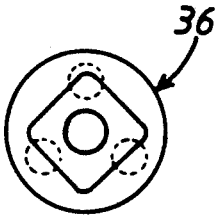
FIG. 13 is a plan view of the connecting shaft shown in FIG. 12.
Figure 14:
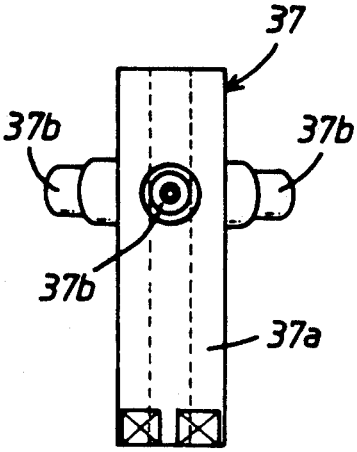
FIG. 14 is a side view of a support shaft shown in FIG. 1.
Figure 15:
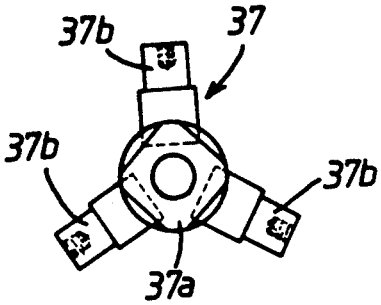
FIG. 15 is a bottom view of the support shaft shown in FIG. 14.

As clearly shown in FIG. 16, the support shaft 37 is coaxially connected to the upper shaft portion 12*b* of auger 12 through a connecting shaft 36. As shown in FIGS. 12 and 13, the connecting shaft 36 is in the form of a columnar member which is formed at its lower end with three circumferentially equally spaced holes for engagement with positioning pins (not show) and at its upper end with a square recess for engagement with the lower end of support shaft 37. As shown in FIGS. 14 and 15, the support shaft 37 has a columnar body portion 37*a* formed with three circumferentially equally spaced radial projections 37*b* for support of the cam follower rollers 38. The support shaft 37 is coaxially engaged with the upper end of connecting shaft 36 at its lower end and is fixedly connected to the auger 12 by means of a fastening bolt 39 threaded therethrough into the upper shaft portion 12*b* of auger 12. The cam follower rollers 38 are rotatably mounted on the radial projections 37*b* of support shaft 37. In a condition where the support shaft 37 has been connected to the auger 12, the support shaft 37 is extended upwardly through the support member 33 and the upper flange 35*b* of head case 35 in a liquid-tight manner in such a manner as to be axially slidable and rotatable relative to the support member 33 and the upper flange 35*b* of head case 35, and the cam follower rollers 38 are maintained in engagement with the cam surface 34*b* of cam ring 34. In addition, the cylindrical body portion 32*a* of connecting member 32 is formed at its upper portion with a drain hole 32*g* to which a drain pipe 17 is connected and extended therefrom outwardly through an elogated hole 16*a* of discharge duct 16.

In operation of the icemaker, ice crystals formed on the internal freezing surface of evaporator housing 11 are scraped by the helical blade 12*d* of auger 12 and introduced into the ice extruding passages formed by the extrusion head 31. In the extrusion head assembly 30, the connecting shaft 36, support shaft 37 and cam follower rollers 38 rotate with the auger 12, while the extrusion head 31, connecting member 32, support member 33, cam ring 34 and head case 35 are applied with upward thrust forces exerted by the auger 12 as it moves the scraped ice crystals upwardly into the extruding passages. Thus, the cam follower rollers 38 rotate on the cam surface 34*b* of ring 34 under the load of the upward thrust forces acting on the cam ring 34 through shafts 36, 37.

Figure 17:
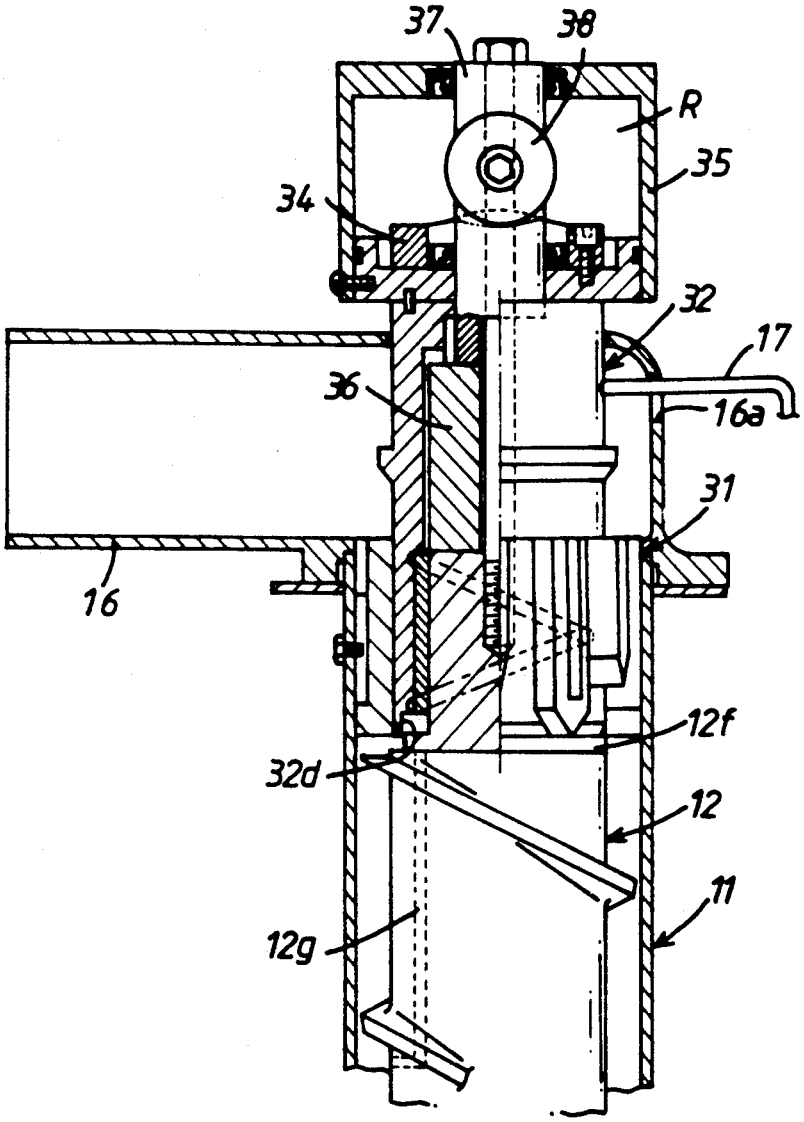
FIG. 17 is a partly broken sectional view showing a second mode of operation of the icemaker shown in FIG. 1.

When the cam follower rollers 38 are brought into engagement with the concave portion $34b_1$ of cam surface 34*b*, the extrusion head 31 is raised by the upward thrust forces acting thereon to a top dead center as shown in FIG. 17. This is effective to facilitate introduction of the scraped ice crystals into the extruding passages. When the cam follower rollers 38 are brought into engagement with the convex portion $34b_2$ of cam surface 34*b*, the extrusion head 31 is lowered by the downward thrust force applied thereto from the cam follower rollers 38 to a bottom dead center as shown in FIG. 16. In this instance, the scraped ice crystals are compressed in the course of passing through the extruding passages and extruded upwardly as relatively hard rods of ice. The rods of ice extruded from the extruding passages are broken by a shearing force applied thereto at the annular flange 32*c* of connecting member 32 and discharged from the duct 16.

During such operation of the icemaker as described above, a portion of fresh water to be frozen is supplied into a space between the connecting member 32 and liner sleeve 12*e* through the communication passage 12*g* and spiral groove 32*f* and is discharged through the drain pipe 17. The supply of fresh water serves to lubricate the sliding portion of liner sleeve 12*e* relative to the connecting member 32, and metal particles caused by defacement of the liner sleeve 12*e* are discharged with the supplied water outwardly through the drain pipe 17. The chamber R formed in the head case 35 is useful to store lubricating oil for lubrication of the cam ring 34 and cam follower rollers 38.

As is understood from the above description, the icemaker is characterized in that the extrusion head 31 is axially movably assembled within the upper end portion of evaporator housing 11 and fixed to the evaporator housing 11 only in the circumferential direction and that the cam follower rollers 38 are mounted on the upper shaft portion 12*b* of auger 12 by means of shafts 36, 37 for rotation therewith to restrict upward movement of the extrusion head 31. In such a mounting construction of the extrusion head 31, the cam follower rollers 38 act to absorb a major portion of the thrust forces generated by the action of the auger 12 in feeding ice crystals to the extrusion head 31. Accordingly, the thrust forces acting on the evaporator housing 11 at the mounting portion of the extrusion head 31 becomes noticeably smaller than that in the conventional mounting construction of the extrusion head. Thus, the wall thickness of the evaporator housing 11 can be reduced at the mounting potion of the extrusion head 31, and small screws can be used for mounting the extrusion head 31.

Figure 18:
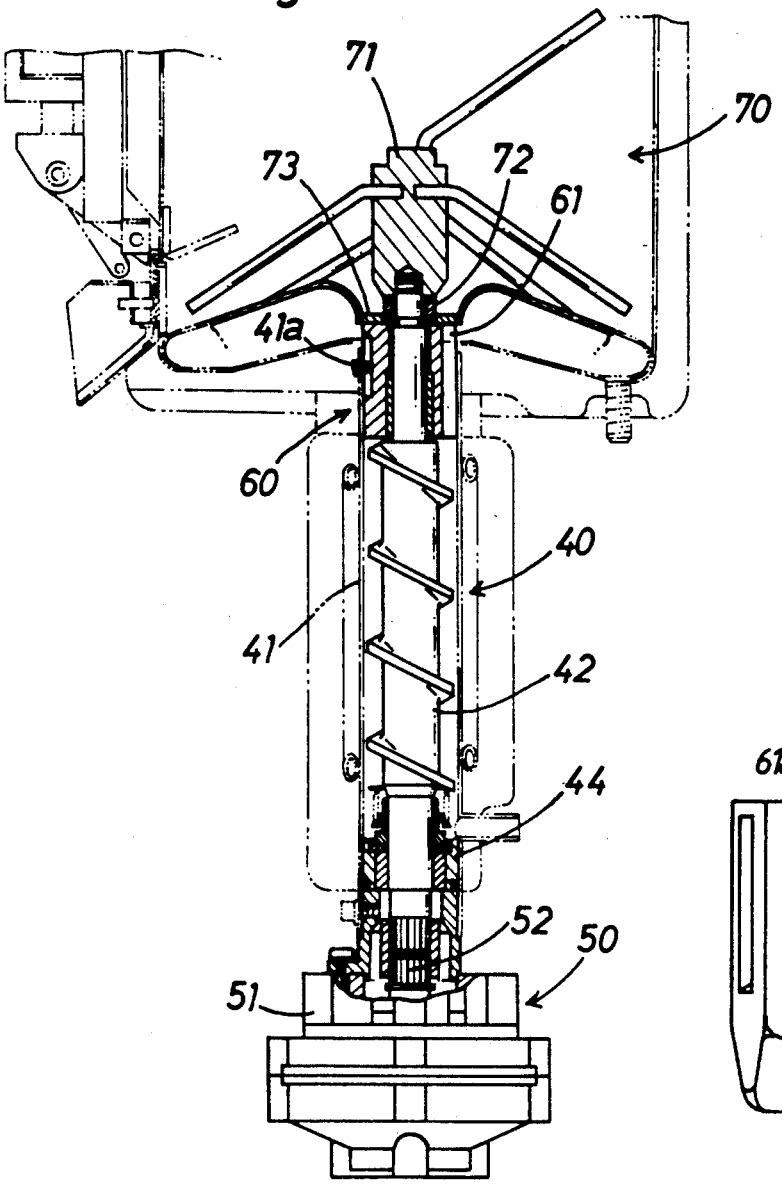
FIG. 18 is a sectional elevational view of an alternate embodiment of the present invention adapted to a conventional auger type icemaker.

Illustrated in FIG. 18 is an alternate embodiment of the present invention adapted to a conventional auger type icemaker which includes a freezing mechanism 40, a drive mechanism 50, an extrusion head assembly 60 and an agitator assembly 70. The freezing mechanism 40 includes a cylindrical evaporator housing 41 vertically mounted on a housing 51 of the drive mechanism 50 through a cylindrical support member 44 and an auger 42 mounted for rotary movement within the evaporator housing 41. The auger 42 has a lower shaft portion drivingly connected to a drive shaft 52 of the drive mechanism 50 by means of a spline coupling and an upper shaft portion rotatably supported by an extrusion head 61 through a liner sleeve. The agitator assembly 70 is mounted on the upper shaft portion of auger 42.

Figure 19:
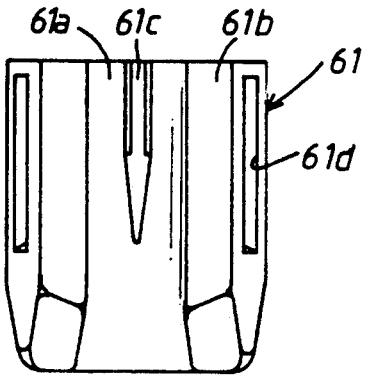
FIG. 19 is a side view of an extrusion head shown in FIG. 18.
Figure 20:
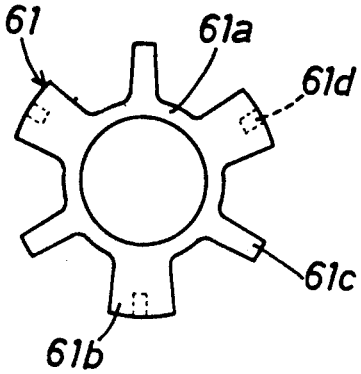
FIG. 20 is a plan view of the extrusion head shown in FIG. 19.

As shown in FIGS. 19 and 20, the extrusion head 61 has a cylindrical body portion 61*a* which is formed with a plurality of circumferentially equally spaced full fins 61*b* and a plurality of relatively shorter fins 61*c* located between adjacent pairs of full fins 61*b*. The full fins 61*b* are extended from top to bottom of the body portion 61*a* and tapered to knife edges at the lower ends thereof. The full fins 61*b* are formed larger in width than the shorter fins 61*c* and each formed with an axial keygroove 61*d*. The shorter fins 61*c* are extended downwardly from the top of body portion 61*a* for a distance which is less than the full length of body portion 61*a*. Similarly to the full fins 61*b*, the shorter fins 61*c* are tapered to knife edges at the lower ends thereof.

As shown in FIG. 18, the extrusion head 61 is assembled within an annular space between the upper end of evaporator housing 41 and the upper shaft portion of auger 42, and key screws 41*a* are radially threaded into the evaporator housing 41 and engaged with the keygrooves 61*d* of full fins 61*b* to restrict rotary movement of the extrusion head 61 relative to the evaporator housing 41. The agitator assembly 70 includes a hub member 71 which is threadedly fixed to the upper end of the upper shaft portion of auger 42 through a thrust bearing 72 and a spacer 73 to restrict upward movement of the extrusion head 61. In such a mounting construction of the extrusion head 61, the auger 42 acts to absorb a major portion of the thrust forces generated by the action of the auger 42 in feeding ice crystals to the extrusion head 61. Accordingly, the thrust force acting on the evaporator housing 41 at the mounting portion of the extrusion head 61 becomes noticeably smaller than that in the conventional mounting construction of the extrusion head. Thus, the wall thickness of the evaporator housing 41 can be reduced at the mounting portion of the extrusion head 61, and small screws can be used for mounting the extrusion head 61.

What is claimed is:

1. An auger type icemaker including an evaporator housing having a cylindrical inner freezing surface on which ice crystals may form, an auger mounted for rotary movement within said housing to be driven to scrape ice crystals off said freezing surface and to advance the scraped ice crystals toward an upper end of said housing, an extrusion head formed with a plurality of ice extruding passages and coupled within an annular space between the upper end portion of said housing an upper shaft portion of said auger, and means for stationarily mounting said extrusion head at the upper end portion of said housing, wherein said extrusion head is axially slidably coupled within the annular space between the upper end portion of said housing and the upper shaft portion of said auger, and wherein said mounting means comprises means for restricting rotary movement of said extrusion head at the upper end portion of said housing and a cam mechanism mounted on the upper shaft portion of said auger to effect axial movement of said extrusion head in accordance with rotary movement of said auger and to restrict upward movement of said extrusion head at an upper dead point thereof.

2. An auger type icemaker as claimed in claim 1, wherein said cam mechanism comprises a cylindrical connecting member fixedly coupled within a bore of said extrusion head and extending upwardly therefrom, a cam ring formed thereon with a cam surface and mounted on an upper end of said connecting member, a support shaft coaxially connected to the upper shaft portion of said auger for rotation therewith, and a cam follower element mounted on said support shaft and maintained in engagement with the cam surface of said cam ring for restricting upward movement of said extrusion head at an upper dead point thereof.

3. An auger type icemaker as claimed in claim 2, wherein said cylindrical connecting member includes a cylindrical internal wall surface formed with a spiral groove which is communicated at a lower end thereof with fresh water supplied into said evaporator housing through a communication passage in said auger and connected at an upper end thereof to a drain pipe, and wherein a liner sleeve is coupled with the upper shaft portion of said auger for relative rotation with said cylindrical connecting member and associated with the spiral groove of said connecting member to form a discharge passage for connection of said drain pipe.

4. An auger type icemaker as claimed in claim 2, wherein a head case is mounted on the upper end of said cylindrical connecting member to store lubricating oil for lubrication of said cam ring and said cam follower element.

5. An auger type icemaker as claimed in claim 2, wherein said cylindrical connecting member is formed at an intermediate portion thereof with a radially outwardly extending annular flange which is arranged to break rods of ice extruded from said extrusion head.

* * * * *